US007032624B2

(12) United States Patent
Bruske et al.

(10) Patent No.: US 7,032,624 B2
(45) Date of Patent: Apr. 25, 2006

(54) LOW-VIBRATION SHEDDING SYSTEM

(75) Inventors: Johannes Bruske, Albstadt (DE); Günter Büchle, Bad-Waldsee (DE)

(73) Assignee: Groz-Beckert KG, Albstadt (DE)

( * ) Notice: Subject to any disclaimer, the term of this patent is extended or adjusted under 35 U.S.C. 154(b) by 18 days.

(21) Appl. No.: 10/937,427

(22) Filed: Sep. 10, 2004

(65) Prior Publication Data

US 2005/0051228 A1 Mar. 10, 2005

(30) Foreign Application Priority Data

Sep. 10, 2003 (DE) ..... 103 41 629

(51) Int. Cl.
*D03C 13/00* (2006.01)

(52) U.S. Cl. ..... 139/57; 139/30; 139/73; 139/74; 139/76; 139/88; 267/149

(58) Field of Classification Search ..... 139/55.1, 139/56, 57, 30, 73, 74, 76, 88; 267/149; 248/609, 621, 636, 638, 644, 686
See application file for complete search history.

(56) References Cited

U.S. PATENT DOCUMENTS 1,891,912 A * 12/1932 Bunnell ..... 139/28
2,282,223 A * 5/1942 Hamilton ..... 139/55.1
2,969,971 A * 1/1961 Nelson ..... 267/149
3,067,484 A * 12/1962 Rasero et al. ..... 442/205
3,095,187 A * 6/1963 Sweeney et al. ..... 267/149
3,171,622 A * 3/1965 Tolan, Jr. ..... 248/635
3,968,958 A * 7/1976 Huchette et al. ..... 267/47
4,278,726 A * 7/1981 Wieme ..... 428/300.7
4,369,815 A * 1/1983 Gehring et al. ..... 139/57
4,530,490 A * 7/1985 Misumi et al. ..... 267/47
4,715,409 A * 12/1987 Graf ..... 139/88
4,770,213 A * 9/1988 Peter ..... 139/88

(Continued)

FOREIGN PATENT DOCUMENTS

CH 558 435 1/1975

(Continued)

*Primary Examiner*—Danny Worrell
*Assistant Examiner*—Robert H. Muromoto
(74) *Attorney, Agent, or Firm*—Fitch, Even, Tabin & Flannery; Norman N. Kunitz

(57) ABSTRACT

A novel rod linkage for driving a heddle shaft includes at least one strap (16), which for damping oscillation has a sandwich structure (37) oriented in the longitudinal direction (L) of the strap assembly (16). The sandwich structure includes at least one rigid element (27), extending in the longitudinal direction, which is joined to one end (17) of the strap assembly (16); a second rigid element (31), likewise extending essentially in the longitudinal direction, which is joined to the other end (19); and a two-dimensional damping element (34), again extending in the longitudinal direction, disposed between the first two. The element (34) exclusively effects the mechanical connection of the two parts (16*a*, 16*b*) of the strap assembly (16). Preferably, no additional connecting elements, such as rivets, screws, or other rigid connections, between the rigid elements (27, 31) are provided. Preferably, the rigid elements (27, 31) are embodied as wedges pointing in opposite directions, which thus define a wave resistance that varies in opposite directions in the longitudinal direction. This wave resistance brings about an intentional coupling misadaptation with respect to the oscillation transmission. The element (34) disposed between them damps the oscillations additionally, so that the strap assembly (16) transmits driving motions like a filter and destroys or absorbs interfering oscillations.

11 Claims, 5 Drawing Sheets

U.S. PATENT DOCUMENTS

| | | | | |
|---|---|---|---|---|
| 4,772,044 | A * | 9/1988 | Booher | 280/124.134 |
| 5,002,096 | A * | 3/1991 | Bucher et al. | 139/57 |
| 5,102,107 | A * | 4/1992 | Simon et al. | 267/152 |
| 5,645,111 | A * | 7/1997 | Lindblom | 139/55.1 |
| 6,460,838 | B1 * | 10/2002 | Bradley et al. | 267/149 |
| 6,524,692 | B1 * | 2/2003 | Rosen | 428/298.4 |

FOREIGN PATENT DOCUMENTS

| | | |
|---|---|---|
| DE | 78 32 985 U1 | 7/1979 |
| DE | 296 11 305 U1 | 10/1996 |
| EP | 0 870 856 A1 | 10/1998 |
| FR | 2 677 723 | 12/1992 |

* cited by examiner 19
23
24
16b
36
16'
31
16
37
32
33
34
35
16a
L
28
27
17
21
22
16'b
16''b
16''
38
39
16'a
16''a
42
41
43
44

19
17
16
16a
16b
16'
27
31
34
38
39
46
47
48
49
50
X
XI

LOW-VIBRATION SHEDDING SYSTEM

CROSS REFERENCE TO RELATED APPLICATION

This application claims the priority of German Patent Application No. 103 41 629.3, filed on Sep. 10, 2003, the subject matter of which, in its entirety, is incorporated herein by reference.

FIELD OF THE INVENTION

The invention relates to a system for driving a heddle shaft of a power loom.

BACKGROUND OF THE INVENTION

Power looms have so-called shedding systems, which serve to move warp yarns upward or downward out of the warp yarn plane in order to form a so-called shed so that a weft yarn can be inserted. The weft yarn insertion systems, which employ water or air, for instance, have a power potential for maximum weaving speeds. As a rule, however, this potential cannot be fully exploited, because the existing shedding systems cannot withstand the loads that result from an overly high operating speed. The loads result from the accelerations in the up-and-down motion of the shafts with which the heddles are retained. The motion is generated by so-called eccentric machines or shaft machines. Although the most harmonic possible motions are sought here and achieved, nevertheless vibration occurs in the shedding system and the associated mechanism that connects the heddle shafts with the eccentric machines. This vibration puts a load on all the elements of the shedding system and leads to premature wear or breakage of components. Heddle breakage, warp yarn breakage, and the resultant down times of the machines are the result of such excessive loads.

Various concepts with a view to reducing wear in the shedding system and reducing vibration have been developed:

For instance, from Swiss Patent Disclosure CH 558 435, a heddle shaft drive mechanism is known that includes a rod linkage disposed between the heddle shaft and a shaft mechanism.

The rod linkage includes a strap assembly with a built-in shock absorber. In one variant embodiment, the shock absorber may be embodied as a rubber block. It then connects two rigid halves of the strap assembly that extend away from it.

Such a rubber block achieves adequate oscillation damping only if it has considerable axial resilience, which is disadvantageous for the precision of shaft motion. Moreover, it is an additional mass that must be moved and that in cooperation with further elements, such as connections that have play, may again be a source of vibration.

From Utility Model 7832785, a rod linkage for driving a heddle shaft is also known, in which bell crank levers disposed below the shaft are connected to the shaft via thrust rods. In the upper eyelet or joint of each thrust rod, elastic elements are provided, in the form of vulcanized bodies. The damping elements are thus located at the output of the rod linkage that connects the shaft machine to the heddle shaft.

From German Utility Model DE 296 11 305, a device for oscillation damping of heddle shafts is known in which oscillation damping devices are disposed on the guide face, toward the warp beam, of guide elements of the heddle shaft. These devices are formed by a soft rubber plate, for instance.

A guide piece provided on the heddle shaft extends along the soft rubber plate, and as a result, oscillations of the heddle shafts that extend in the direction of the warp yarns can be damped.

From Swiss Patent 549 668, a rod linkage for driving a heddle shaft is known which has spring joints instead of conventional hinge joints. These spring joints are formed by leaf springs or rubber blocks. This provision serves to reduce the wear that otherwise occurs at the joints. Moreover, the goal is to largely avoid the necessity of lubricating joints that move slowly back and forth.

From European Patent Disclosure EP 0 870 856 A1, a rod linkage provided for driving a heddle shaft is known that is connected to the shaft drive via a cushioned strap assembly. To that end, the strap assembly is divided into two parts, between which a compression spring assembly is operative.

The resilience of such a spring assembly may be unwanted.

SUMMARY OF THE INVENTION

With this as the point of departure, the object of the present invention is to create a mechanism in whose force transmission path at least one strap assembly is disposed, with a longitudinally oriented sandwich structure comprising different materials. At least one of the materials used has oscillation-absorbing properties. As a consequence of the longitudinal orientation, on the one hand a lightweight, low-mass construction and on the other good oscillation absorption are attained. In particular, it is possible to impart high axial rigidity to the strap assembly, yet on the other hand good oscillation absorption properties are attainable. This makes it possible to transmit strong axial forces for attaining very fast shaft motions, without sacrifices in terms of positioning imprecision, and the inducement of oscillations as a consequence of the jolting or shocklike motions can be reduced sharply by the strap assembly.

Preferably, the absorber element is embodied two-dimensionally as a closed face. However, it may also be embodied as a honeycomb structure, or as a flat part provided with openings or recesses. Preferably, it comprises a natural or synthetic elastomer, such as natural rubber. It is joined materially, for instance two-dimensionally, by adhesive bonding or vulcanization to the adjacent elements that are of metal or a rigid plastic. Alternatively, it may be retained by rivets or other kinds of positive-engagement connecting means between the other elements of the sandwich assembly. However, an arrangement in which the connection between the two strap assembly parts is created entirely and exclusively by the oscillation-absorbing element is preferred. In such an arrangement, all the forces operative between the ends of the strap assembly travel exclusively through the body of the oscillation-absorbing element. There are no detours or other connections between the ends of the strap assembly that could act to transmit oscillation.

The strap assembly may have stiffer wall regions of a metal or a rigid plastic; the two-dimensional absorber element serving to absorb oscillation is formed of rubber or some other elastomer. The rigid wall regions extending in the longitudinal direction may be embodied in wedgelike fashion, which makes especially good oscillation absorption possible. It is preferred that the rigid wall regions be embodied as a plate, for instance with parallel faces, whose borders extending in the longitudinal direction are bent at an angle for the sake of reinforcement. The borders, bent for instance at a right angle, may be embodied as wedge-shaped; that is, in that case their free edge is at an acute angle to the other two-dimensional stiff wall region and thus to the longitudinal direction. The strap assembly described is preferably attached immediately to a shaft machine, in order from the very outset to prevent transmission of oscillation from the shaft machine to the rod linkage. Further strap assemblies in accordance with the invention may be disposed in the rod linkage. In addition, it is possible to make further damping provisions. For instance, bearings of bell crank levers or joint places may be seated in damping elements, such as rubber rings.

Further details of advantageous embodiments of the invention will become apparent from the drawing, description or claims.

DETAILED DESCRIPTION OF THE INVENTION

Figures 1, 2:
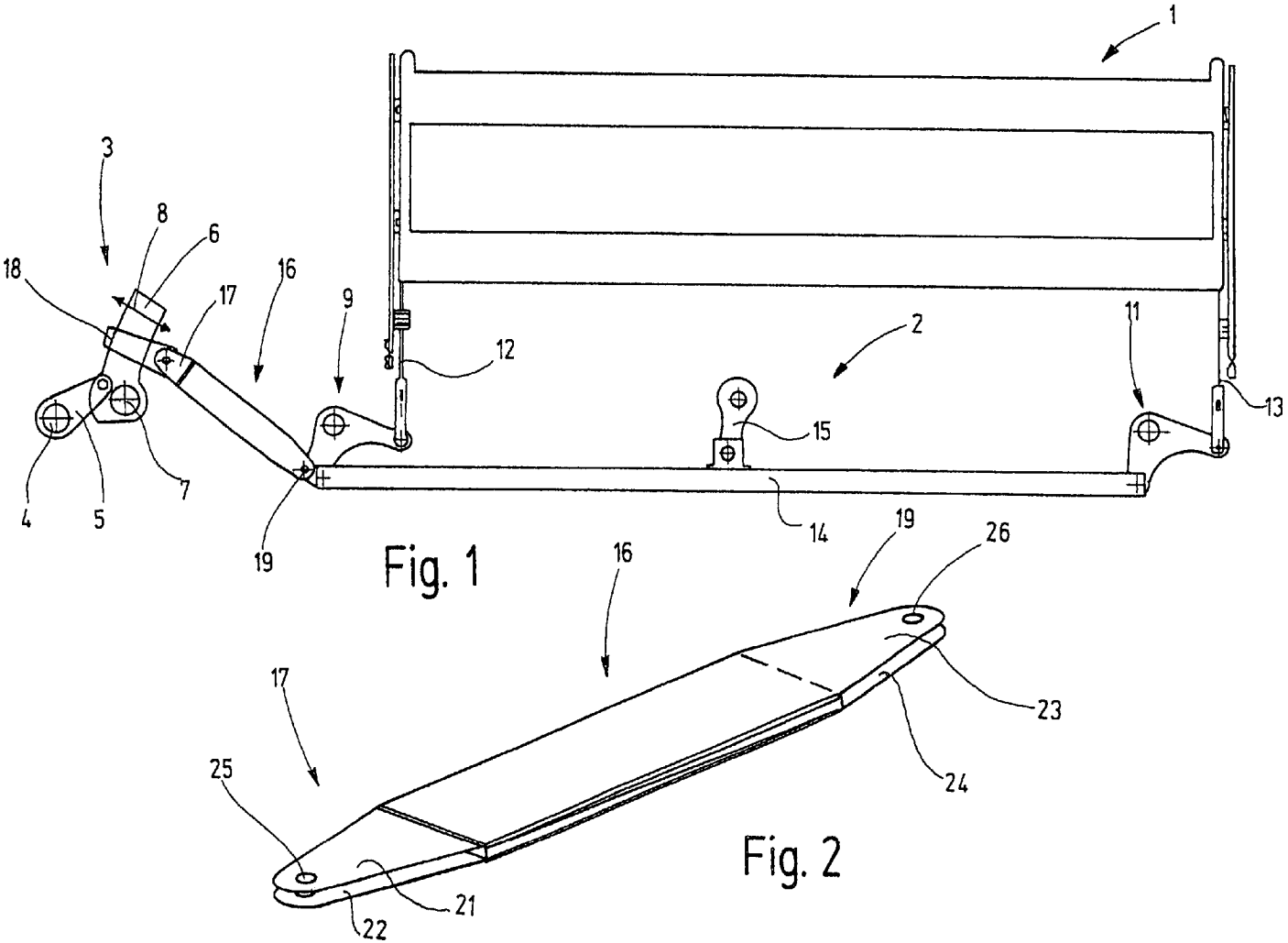
FIG. 1 is a schematic front view of a heddle shaft with a rod linkage and a shaft machine.
FIG. 2 is a perspective view of a strap assembly of the rod linkage of FIG. 1.

In FIG. 1, a heddle shaft 1 is shown, which for shedding purposes is disposed on a power loom, not otherwise shown, and is driven via a rod linkage 2 by a shaft machine 3. The shaft machine 3 is for instance an eccentric machine having an eccentric 4, which via a connecting rod 5 drives a sword 6, serving as a power takeoff mechanism, back and forth. The sword 6 is pivotably supported about a center of pivoting 7. Its pivoting motion is represented in FIG. 1 by an arrow 8.

The rod linkage 2 serving to transmit the reciprocating pivoting motion of the sword 6 to the heddle shaft 1 includes, in the present exemplary embodiment, at least two pivotably supported bell crank levers 9, 11, which are joined to the heddle shaft 1 via tension and pressure rods 12, 13 in order to move the heddle shaft up and down. The lower arms of the bell crank levers 9, 11 are joined to one another by a connecting bar 14, which is pivotably connected to the respective arms of the bell crank levers 9, 11. The connecting bar 14 can be supported at the center by a sword 15, which is joined by one end pivotably to the connecting bar 14 and by its other end to a pivot bearing. The connection between the bell crank lever 9, which is disposed adjacent the shaft machine 3, and the shaft machine 3 itself is created by a strap assembly 16, one end 17 of which is pivotably connected to a glider 18 that is seated on the sword 6. Its other end 19 is pivotably connected to the lower arm of the bell crank lever 9.

The strap assembly 16 is shown separately in FIG. 2. It is embodied overall as an oscillation damping element and is rigid in the axial direction. On its ends 17, 19, it is bifurcated. Two flat, parallel-oriented arms 21, 22; 23, 24 in respect to pairs define between them an interstice for receiving the glider 18 or the bell crank lever 9, respectively. A bore 25, 26 extending transversely all the way through serves to receive one bearing bolt each.

Figures 3, 4, 5:
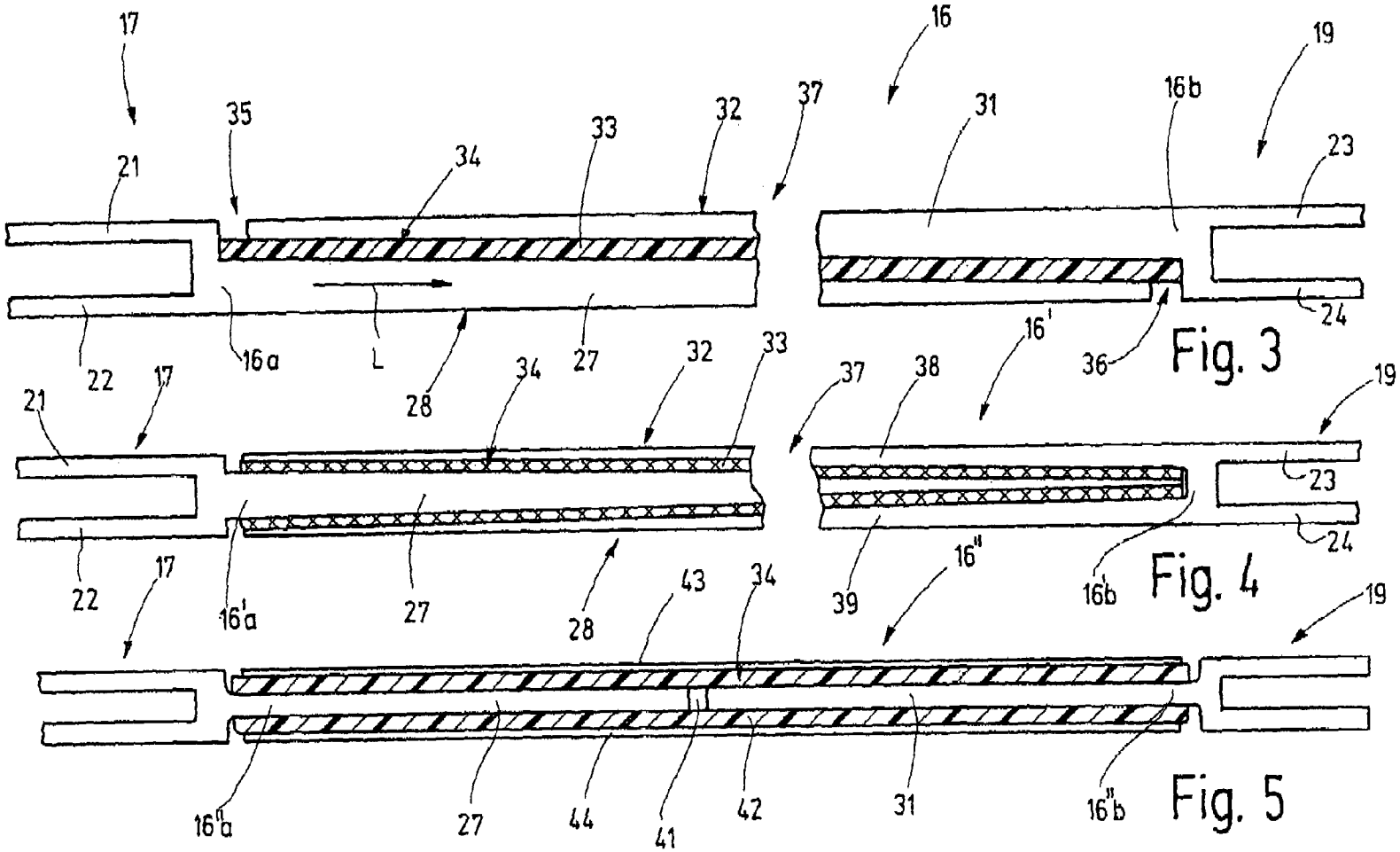
FIG. 3 is a fragmentary plan view on a different scale of the strap assembly of FIG. 2.
FIGS. 4 and 5, each in fragmentary plan view, shown modified embodiments of the connecting strap assembly.

The strap assembly 16 is shown separately in FIG. 3. From the end 17, an elongated, tonguelike extension 27 extends away; as shown in FIG. 2, it preferably has a rectangular outline. Its thickness likewise preferably decreases from the end 17 in the longitudinal direction L of the strap assembly. The outer face 28 of the extension 27 is in the same plane as the outer face of the arm 22. The inside face is inclined relative to that plane. The outer face 28 is moreover in essentially the same plane as the outer face of the arm 24. The part described thus far forms a first part 16*a* of the strap assembly 16. This strap assembly includes a complementary part 16*b*, whose extension 31 is likewise embodied in wedgelike form in the longitudinal direction L of the strap assembly. Once again, its outer face 32 is in the same plane as the outer faces of the arms 21, 23.

Between the two extensions 27, 31, a seam 33 is formed, preferably at an acute angle to the longitudinal direction L of the strap assembly, and this seam is filled by an elongated, flat element 34 of an elastomer material. The element 34 completely separates the extensions 27, 31 from one another, so that they do not touch directly anywhere. Between the face ends of the extensions 27, 31 and the respective adjacent ends 17, 19, a respective gap 35, 36 is formed, which prevents contact even under a vibrational load.

The element 34 is preferably a material with high internal damping or high internal friction. It fills the seam 34 preferably completely and without gaps over the entire width and length and is glued or otherwise, for instance by vulcanization, materially joined to the extensions 27, 31. It may have parallel faces, as shown, or be embodied as wedge-shaped.

The extensions 27, 31, with the element 34, form a sandwich assembly 37, which serves on the one hand to rigidly transmit driving motions from one end 17 to the end 19 and on the other not to transmit jolts and oscillations, or to do so only very incompletely. Shock waves or other oscillations are effectively damped, regardless of whether their direction of oscillation is longitudinal or transverse to the longitudinal direction L of the strap assembly.

The arrangement described thus far and comprising the heddle shaft 1, rod linkage 2 and shaft machine 3, functions as follows:

In operation, the sword 6 executes a reciprocating motion, within the context of which it essentially remains more or less briefly in its extreme positions. The pivoting of the sword 6 out of one extreme position to another is then effected in each case with a brief, fast pivoting motion with great acceleration out of one dead center position and with major braking upon entering the other dead center position. This motion is transmitted via the strap assembly 16 to the bell crank lever 9 and via the connecting bar 14 to the bell crank lever 11, and as a result the heddle shaft 1 is raised or lowered. Weaving heddles are retained with longitudinal play on the heddle shaft, and in this abrupt positioning operation they strike their heddle support rails and thereby introduce considerable vibration into the heddle shaft. Moreover, vibration is engendered by the heddle shaft itself, and, like the high-frequency vibration of the weaving heddles, this vibration reaches the rod linkage 2. Further vibration originates in the shaft machine 3. This is generally true, but vibration can be found particularly whenever the shaft machine includes shifting clutches that are engaged and disengaged while stopped. The connecting strap assembly 16 dissipates this vibration. Shock waves introduced for instance at the end 17 travel partly along the wedge-shaped extension 17, where they are damped by the element 34. Moreover, they travel through the elastomer and are damped in the process. Because of the great difference in the speeds of sound through rubber and steel, in a ratio of approximately 1:70, structure-borne sound is extensively reflected at the boundary face between rubber and steel. Thus the strap assembly 16, in each of its embodiments, prevents the propagation of sound. In the embodiment of FIG. 3, as a consequence of the tapering of the extensions 27, 31 toward their end, the wave resistance for the conduction of shock waves varies in the longitudinal direction. There is therefore especially broad-band damping of the waves or vibration. In particular, waves are prevented from being reflected at the free end of the extension 27 and travelling back again. The same is true for the extension 31.

Although the damping action of the sandwich assembly 37 is thus broadband in nature and good, high rigidity is attained in the longitudinal direction L of the strap assembly. With regard to transmitting the driving motion, the sandwich structure 37 forms a rigid transmission element, while for jolts and oscillations it acts as a severely damped wave guide.

While the strap assembly 16 in FIG. 3 is composed of two structurally identical parts 16*a*, 16*b*, the strap assembly 16' of FIG. 4 is composed of different but complementary parts 16'*a*, 16'*b*. The extension 27 of the part 16'*a* extends parallel to the center plane of the applicable part and tapers in wedgelike fashion toward its free ends. The extension 31 of the part 16'*b* is bifurcated. Its two arms 38, 39 have parallel outer faces 28, 32. The space enclosed between these faces tapers in wedgelike fashion and symmetrically to the center plane toward the end 19. The extension 27 does not touch the arms 38, 39. The seam 33 remaining between the elements, which in this case is V-shaped, has a constant thickness and is filled by the element 34 made of elastomer. The element 34 makes a material connection between the arm 38, the extension 27, and the arm 39, thus in turn forming the sandwich assembly 37.

For further details, see the above description of FIGS. 1 through 3, using the same reference numerals.

FIG. 5 shows a further-modified embodiment of the connecting strap assembly, as a connecting strap assembly 16". This strap assembly is again based on two matching parts 16"*a*, 16"*b*, which do not overlap in this case. Instead, the wedgelike or parallel-flanked extensions 27, 31 extend toward one another in the same plane, and the face ends of their ends together define a gap 41. Platelike elements 34, 42 serving to provide damping and vibration absorption rest on the two flat sides of the two extensions 27, 31 and are two-dimensionally joined to them, for instance being glued to them. On their outside, the elements 34, 42 are provided with rigid cover plates 43, 44, oriented in the longitudinal direction L of the strap assembly, which are glued on or vulcanized on, for instance. The elements 34, 42 may, like the cover plates 43, 44, have a constant thickness in the longitudinal direction. However, it is also possible to embody the cover plates 43, 44 in double wedgelike fashion, so that in the vicinity of each of the ends 17, 19 they each have their least thickness, while they have their greatest thickness in the middle at the gap 41. This strap assembly 16" likewise provides good oscillation damping with high axial rigidity. The parts 16*a*, 16*b*, 16'*a*, 16'*b*, and 16"*a*, 16"*b* may be embodied of metal or of a fiber-reinforced, rigid plastic. This plastic may be provided with metal inlays, for instance in the region of the arms 21, 22, 23, 24. The material comprising the element 34 is preferably a material with low internal damping, such as a polyurethane or natural rubber. A strap assembly 16, 16', 16" of this kind may serve as a connecting element of a rod linkage for driving a heddle shaft 1 of a shaft machine 3, or some other drive mechanism, and may also serve as a connecting element inside the rod linkage.

Figures 6, 7, 8, 9, 10, 11:
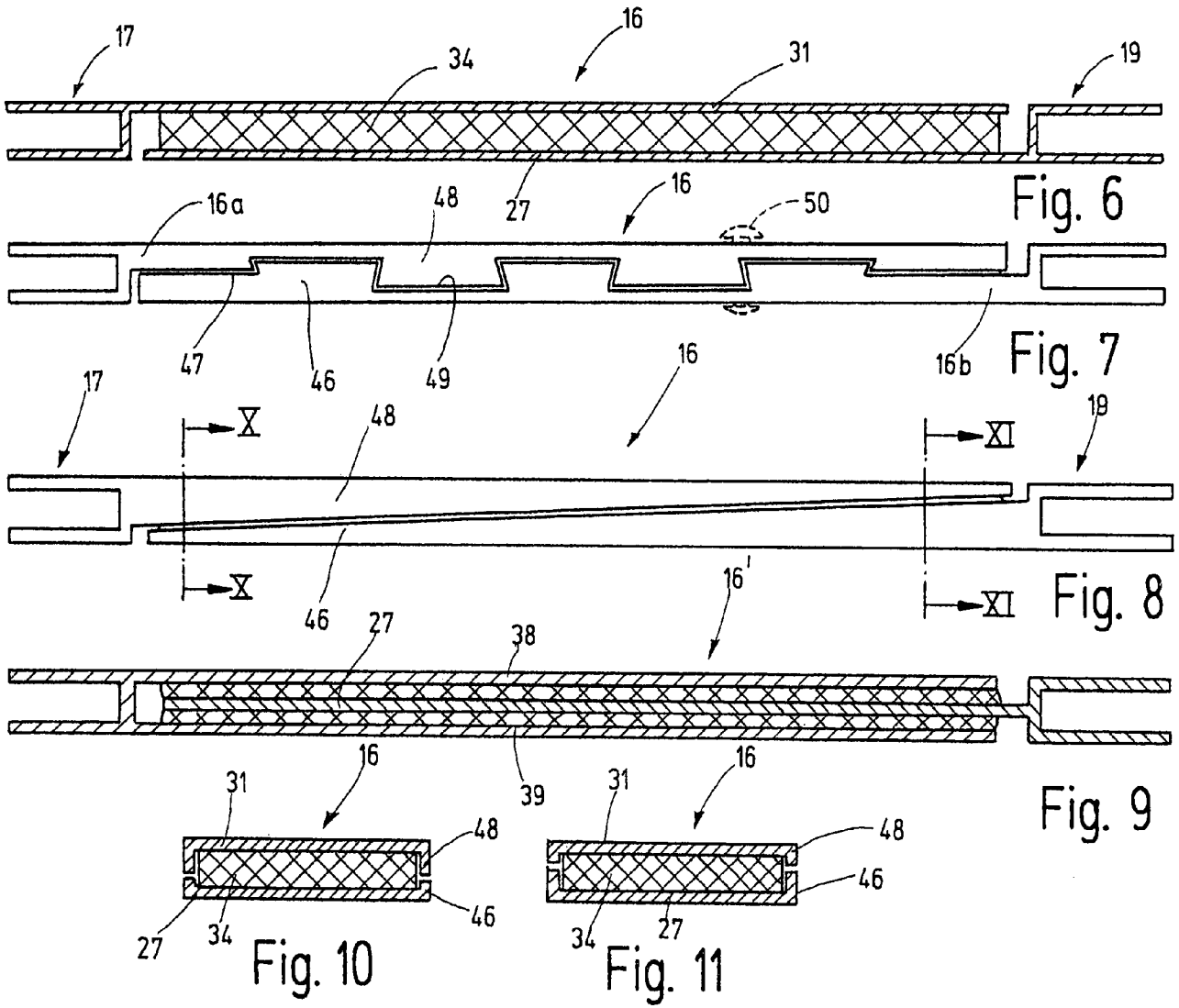
FIG. 6 is a longitudinal section through a further embodiment of a strap assembly according to the invention.
FIG. 7 is a plan view of a variant embodiment of the strap assembly of FIG. 6.
FIG. 8 is a plan view of a further variant embodiment of the strap assembly of FIG. 6.
FIG. 9 is a symmetrical longitudinal section through one embodiment of the strap assembly of the invention.
FIG. 10 is a sectional view along the line X—X through the strap assembly of FIG. 8.
FIG. 11 is a sectional view along the line XI—XI through the strap assembly of FIG. 8.

A further modified, currently preferred embodiment of the strap assembly 16 of the invention is shown in FIG. 6. For the sake of explanation, the full contents of the description of the strap assembly 16 of FIG. 3 is referred to, with the following differences:

The extensions 27, 31 extend as flat, platelike elements away from the ends 17, 19 and are disposed parallel to one another. The element 34, embodied with a greater thickness here, is disposed between the extensions 27, 31 and comprises polyurethane or natural rubber, and its thickness exceeds the thickness of the extensions 27, 31 substantially. To stiffen the extensions 27, 31, their longitudinally extending borders may be crimped over, but the borders of the extensions 27, 31 preferably do not touch. The free edges of these crimped-over borders may be embodied rectilinearly. FIG. 7 shows a modified embodiment in which these borders are not rectilinear, so as to lend the strap assembly emergency-operation properties in the event of tearing or breakage of the element 34. The border 46, extending approximately at a right angle away from the extension 27, has a zigzag edge 47. The border 48 extending approximately at a right angle away from the extension 31 toward the border 46 likewise has a zigzag edge 49. The zigzags of the borders 46, 48 mesh with one another but without touching. They may be embodied as rectangular or, as shown, trapezoidal crenellations or zigzags, whose spacing from one another is so great that vibration absorbed by the element 34 does not cause the borders to touch. However, if the element 34 tears or breaks, the crenellations meshing with one another by positive engagement of the borders 46, 48 can bring about a transmission of motion and thus coupling of the parts 16*a*, 16*b* of the strap assembly 16, which guarantees certain emergency-operation properties.

The seam between the borders 46, 48 may also, as shown in FIG. 8, extend rectilinearly and be disposed at an acute angle to the longitudinal direction of the strap assembly 16 as shown in FIG. 6. Then the borders 46, 48 preferably seamlessly adjoin the respective end 17, 19, thereby making a major contribution toward stiffening the strap assembly 16. FIGS. 10 and 11 show the arrangement of the elements 34 in the interior enclosed by the extensions 27, 31 and their borders 46, 48. Preferably, the element 34 with the borders 46, 48 and again on the opposite side forms one gap each, as a result of which largely homogeneous loading of the element 34 is achieved.

A further-modified embodiment of the element 16' is shown in FIG. 9. It is largely based on the embodiment of the strap assembly 16' of FIG. 4, with the difference that the extension 27 and the arms 38, 39 are each embodied not in wedge-shaped fashion but as thin-walled components with parallel flanks or parallel faces. Otherwise, reference may be made to the description of FIG. 4. The borders of the arms 38, 39 may be bent at an angle, specifically similarly to what is shown in FIG. 10 or FIG. 11. It is also possible for the borders of the extension 27 to be bent at an angle, as a result of which they are given a flat U- or Z-shaped profile. In the shaping of the borders, the principles of FIG. 7 or FIG. 8 may be exploited; that is, the existing seams may be rectilinear, straight or oblique or embodied as a zigzag line.

The strap assembly presented may, in FIG. 1, serve as a connection between the shaft machine 3 and the rest of the rod linkage 2. It is also possible for the connecting bar 14 to be embodied like the construction of the strap assembly 16. The tension and pressure rods 12, 13 may also include elements such as the strap assemblies 16 or be embodied as such elements. The bell crank levers 9, 11 may be embodied in this way as well. With respect to the embodiment of FIG. 7, it should also be noted that to assure the emergency-operation properties, one or more rivets may be provided, which pass transversely through the strap assembly 16 and are supported in a certain sense in floating fashion. For instance, they may be seated firmly in the element 34 and can pass through the extensions 27, 31 in bores without peripheral contact. Round heads may be disposed in floating fashion above the outer faces 28, 32 of the extensions 27, 31. For the sake of illustration, this is indicated in FIG. 6 by one rivet 50 shown in dashed lines.

Figure 12:
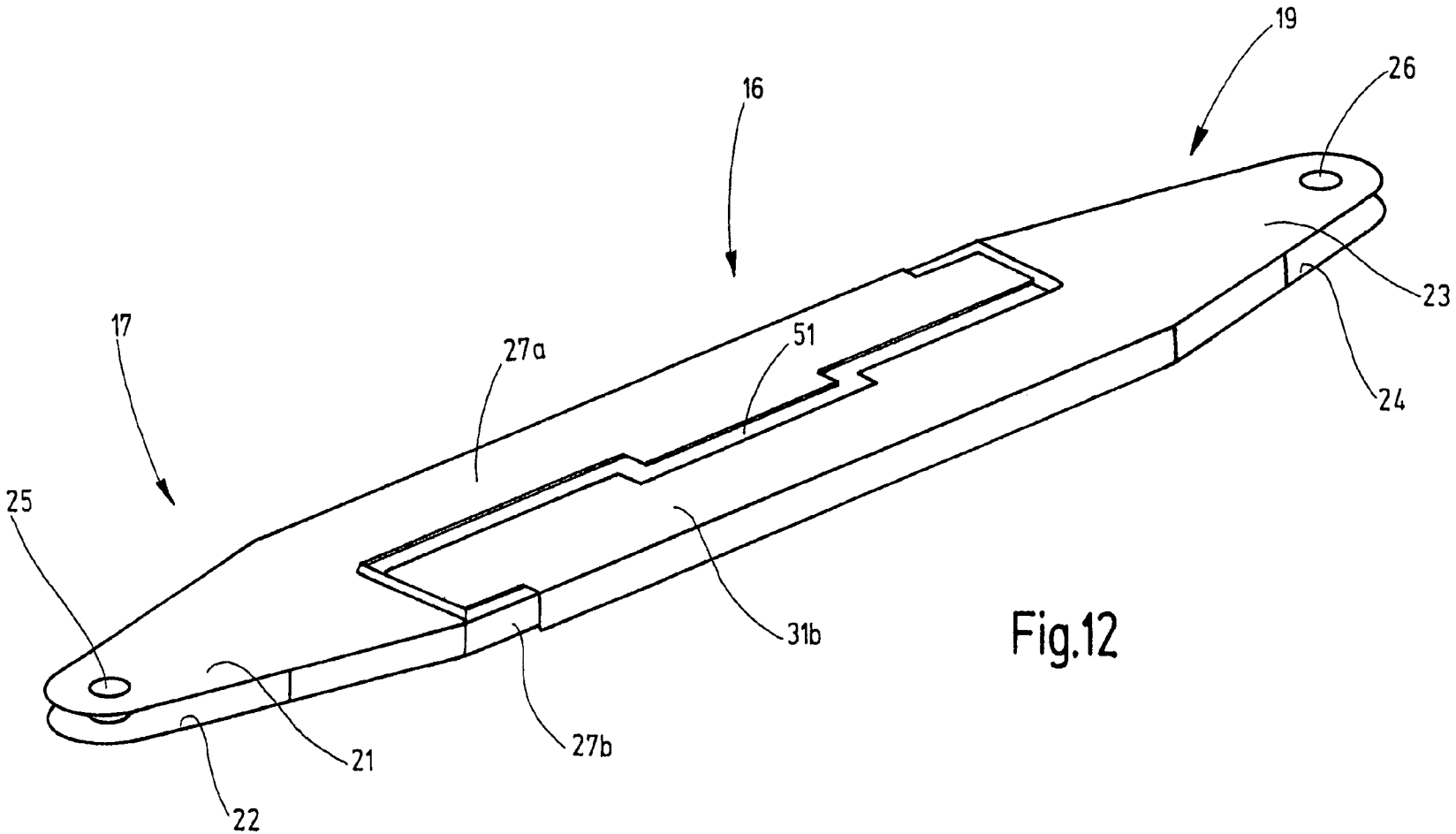
FIG. 12, in a perspective view of its front flat side, shows a reverse-symmetrical embodiment of the strap assembly.
Figures 13, 14:
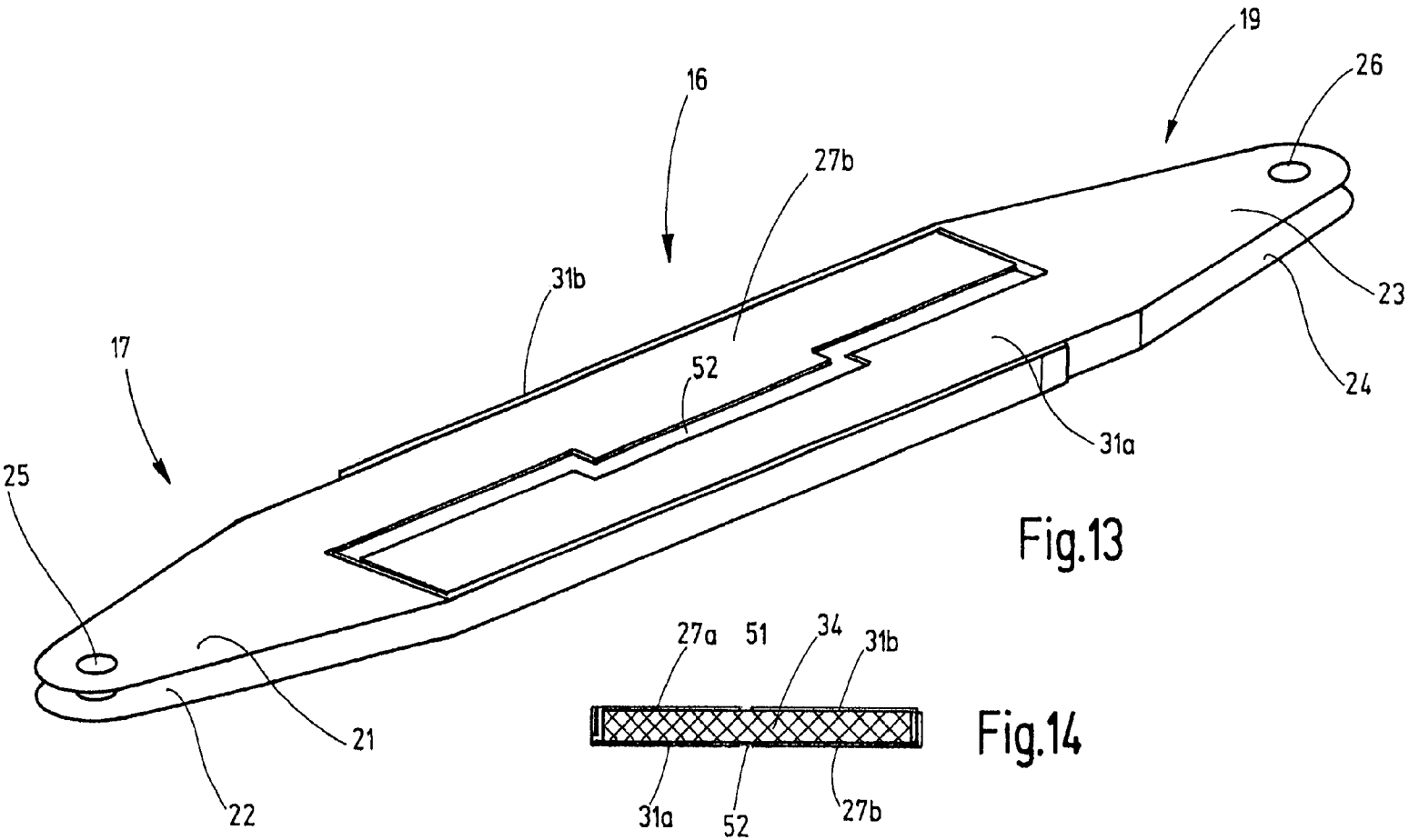
FIG. 13 is a perspective view of the rear flat side of the reverse-symmetrical embodiment of the strap assembly of FIG. 12.
FIG. 14 is a cross-sectional view of the reverse-symmetrical embodiment of the strap assembly.

In FIG. 12, a strap assembly 16 is shown that has proved to be especially suitable. The special feature of this strap assembly 16 is that the extensions 27, 31 extending away from its respective ends 17, 19 are each subdivided into respective extensions 27*a*, 27*b*, 31*a* (see FIG. 13), 31*b*. The extensions 27*a*, 27*b*, as can be seen particularly in FIG. 14, extend along different flat sides of the damping element 34 and do not overlap, or overlap only insignificantly. As can be seen from the cross-sectional view in FIG. 14, the extensions 27*a*, 27*b* are approximately half as wide as the element 34. While the extension 27*a* is disposed at the top left, the extension 27*b* is disposed at the bottom right. Correspondingly, the extensions 31*a*, 31*b* that extend from the end 17 are likewise approximately half as wide as the damping element 34. While the extension 31*a* is disposed in the left half of the bottom of the damping element 34, the extension 31*b* is disposed in right half of the top of the element 34. This disposition that is symmetrical in this way is known as a reverse-symmetrical disposition. The strap assembly of FIGS. 12 through 14 may be rotated 180? about its longitudinal axis, in which case once again the same conditions are created from the standpoint of the damping element.

The extensions 27*a*, 31*b* define a gap 51 between them. The extensions 31*a*, 27*b* define a gap 52 between them. Each gap, as FIGS. 12 and 13 respectively show, is preferably a few millimeters wide and may be embodied in meandering form, as shown. It is oriented in the longitudinal direction of the strap assembly. Alternatively, it can be embodied as straight (not meandering). Moreover, it may be disposed so that it extends at an acute angle to the longitudinal direction.

The extensions 27*a* through 31*b* are each bent at an angle on their outer borders and engage one another there in order to enclose the element 34 from outside. The element 34 is preferably not connected to these angled borders. In a preferred embodiment, this element comprises an elastomer based on natural rubber. It is joined to the steel extensions 27*a* through 31*b* by vulcanizing.

In all the other embodiments shown as well, the damping element 34 may be of natural rubber or some material based on natural rubber.

A novel rod linkage 2 for driving a heddle shaft 1 includes at least one strap 16, which for damping oscillation has a sandwich structure 37 oriented in the longitudinal direction L of the strap assembly 16. The sandwich structure includes at least one rigid element 27, extending in the longitudinal direction, which is joined to one end 17 of the strap assembly 16; a second rigid element 31, likewise extending essentially in the longitudinal direction, which is joined to the other end 19; and a two-dimensional damping element 34, again extending in the longitudinal direction, disposed between the first two. The element 34 exclusively effects the mechanical connection of the two parts 16*a*, 16*b* of the strap assembly 16. Preferably, no additional connecting elements, such as rivets, screws, or other rigid connections, between the rigid elements 27, 31 are provided. Preferably, the rigid elements 27, 31 are embodied as wedges pointing in opposite directions, which thus define a wave resistance that varies in opposite directions in the longitudinal direction. This wave resistance brings about an intentional coupling misadaptation with respect to the oscillation transmission. The element 34 disposed between them damps the oscillations additionally, so that the strap assembly 16 transmits driving motions like a filter and destroys or absorbs interfering oscillations.

It will be appreciated that the above description of the present invention is susceptible to various modifications, changes and adaptations, and the same are intended to be comprehended within the meaning and range of equivalents of the appended claims.

LIST OF REFERENCE NUMERALS

1 Heddle shaft
2 Rod linkage
3 Shaft machine
4 Eccentric
5 Connecting rod
6 Sword
7 Center of pivoting
8 Arrow
9, 11 Bell crank levers
12, 13 Tension and pressure rods
14 Connecting bar
15 Sword
16 Strap assembly
16*a*, 16*b* Parts
17 End
18 Glider
19 End
21, 22, 23, 24 Arms
25, 26 Bore
27, 27*a*, 27*b* Extension
28 Outer face
31, 31*a*, 31*b* Extension
32 Outer face
33 Seam
34 Element
35, 36 Gap
37 Sandwich assembly
38, 39 Arms
41 Gap
42 Element
43, 44 Cover plates

46, 48 Periphery
47, 49 Edge
50 Rivet
51, 52 Gap
L Longitudinal direction

What is claimed is:

1. A mechanism (2) for transmitting a reciprocating driving motion of a shaft machine (3) to a heddle shaft (1), which extends from an input (16), arranged for connection to the shaft machine (3), to a power takeoff mechanism (12, 13), arranged for connection to the heddle shaft (1), and which includes at least one connecting strap assembly (16) that has two ends (17, 19), in which strap assembly a sandwich assembly (37), extending in the longitudinal direction (L) of the strap assembly and comprising at least one two-dimensional extension (27, 31) of rigid material and at least one two-dimensional absorber element (34) of oscillation-absorbing material is accommodated.

2. The mechanism of claim 1, characterized in that the oscillation-absorbing material is an elastomer.

3. The mechanism of claim 1, characterized in that the rigid material is a fiber-reinforced plastic.

4. The mechanism of claim 1, characterized in that the rigid material is a metal.

5. The mechanism of claim 1, characterized in that the sandwich assembly (37) includes a first wall portion, forming the extension (27) of rigid material, that is joined to one of the ends (17), and that the sandwich assembly (37) includes a second wall portion, forming a further extension (31) of rigid material, which is joined to the other of the ends (19), and that the two-dimensional absorber element (34) is disposed between the two extensions (27, 31).

6. The mechanism of claim 5, characterized in that the wall portions (27, 31) are embodied as wedge-shaped in opposite directions in the longitudinal direction.

7. The mechanism of claim 5, characterized in that the absorber element (34) is a plate of constant thickness in the longitudinal direction.

8. The mechanism of claim 5, characterized in that the absorber element (34) is formed by an elastomer layer disposed between the wall portions (27, 31).

9. The mechanism of claim 1, characterized in that the sandwich assembly (37) extends from one end (17) to the other end (19) of the connecting strap assembly (16).

10. The mechanism of claim 1, characterized in that the strap assembly (16) forms the input to the rod linkage (2).

11. The mechanism of claim 1, characterized in that the sandwich assembly (37) is formed in that two two-dimensional extensions (27*a*, 27*b*) of rigid material extend from one end (17) and two two-dimensional extensions (31*a*, 31*b*) of rigid material likewise extend from the other end (19), and the absorber element (34) of oscillation-absorbing material is retained between each two extensions (27*a*, 31*a*; 27*b*, 31*b*) joined to different ends (17, 19).

* * * * *